US008669033B2

(12) United States Patent
Kouyama et al.

(10) Patent No.: US 8,669,033 B2
(45) **Date of Patent: *Mar. 11, 2014**

(54) ELECTROPHOTOGRAPHIC TONER AND PRODUCTION METHOD OF THE SAME

(75) Inventors: Mikio Kouyama, Tokyo (JP); Ken Ohmura, Tokyo (JP); Kenji Hayashi, Tokyo (JP); Hiroaki Obata, Tokyo (JP); Koji Shibata, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 217 days.

This patent is subject to a terminal disclaimer.

(21) Appl. No.: 13/050,246

(22) Filed: Mar. 17, 2011

(65) Prior Publication Data

US 2011/0236819 A1 Sep. 29, 2011

(30) Foreign Application Priority Data

Mar. 24, 2010 (JP) ..... 2010-067839

(51) Int. Cl.
*G03G 9/08* (2006.01)

(52) U.S. Cl.
USPC ..... 430/109.4; 430/108.22; 430/137.15; 430/109.5

(58) Field of Classification Search
USPC ..... 430/109.5, 108.22, 137.15
See application file for complete search history.

(56) References Cited

U.S. PATENT DOCUMENTS 8,304,157 B2 * 11/2012 Kouyama et al. ..... 430/109.5
2007/0207402 A1 * 9/2007 Takagi et al. ..... 430/110.2

FOREIGN PATENT DOCUMENTS

JP 2009-200225 9/2009
JP 2009-210723 9/2009

OTHER PUBLICATIONS

Iwamura et al., Macromolecules 2008, 41, 8995-8999.*

* cited by examiner

*Primary Examiner* — Mark F Huff
*Assistant Examiner* — Rashid Alam
(74) *Attorney, Agent, or Firm* — Lucas & Mercanti, LLP

(57) ABSTRACT

Provided is a toner containing toner particles containing a polyester resin which has a structure part represented by Formula (1):

Formula (1)

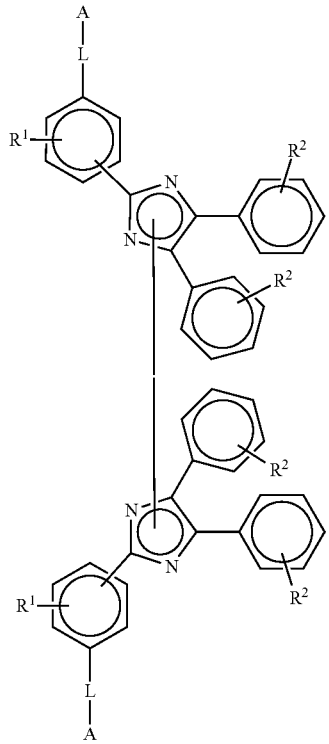

wherein, "A" represents a polyester structure unit having at least one linking group; $R^1$ represents a hydrogen atom, or a chlorine atom; $R^2$ represents a hydrogen atom, a chlorine atom, or a methoxy group; and "L" represents a divalent organic group.

14 Claims, No Drawings

ELECTROPHOTOGRAPHIC TONER AND PRODUCTION METHOD OF THE SAME

CROSS-REFERENCE TO RELATED APPLICATION

This application is based on Japanese Patent Application No. 2010-067839 filed on Mar. 24, 2010 with Japan Patent Office, the entire content of which is hereby incorporated by reference.

TECHNICAL FIELD

The present invention relates to an electrophotographic toner (hereafter, it is also called simply as "a toner") and a method for producing the toner.

BACKGROUND

Conventionally, in the image formation method which forms a visible image by an electrophotographic method, a heat fixing method has been widely used. In this fixing method, heat is used to fix a toner image as a way to fix an image formed on an image supporting material such as paper. In order to secure the fixability in this heat fixing method, i.e., to secure the adhesion property of the toner to the image supporting material, it is required a high amount of heat to some extent.

However, originated from the request of the warming preventive measures for the global environment in recent years, it is also demanded energy saving in the electrophotographic image formation apparatus which adopts the heat fixing method. In order to respond such request, it has been examined the way to reduce the heat needed for image fixation of the toner by using a toner which can fix the image at a low temperature, namely, by using a toner having a property of so called low-temperature fixability. And in order to acquire a tone of low-temperature fixability, it is widely known that a resin having a high sharp-melting nature is an effective approach as a composing element of a toner. A polyester resin is useful as a resin which has such characteristics.

On the other hand, various kinds of toners were proposed in which a polyester resin was contained as a composition of the toner (for example, refer to Patent document 1 and Patent document 2). In order to respond the request of achieving much lower temperature fixability of the visible image demanded in connection with the expanding use of image formation method by an electrophotographic method for various fields, improvement in further low-temperature fixability was intended by setting up the molecular weight to be low, for example.

However, in the toner containing a polyester resin of low molecular weight described in Patent document 1 and Patent document 2, there are problems of generating photoreceptor filming caused by mechanically weak polyester resin and carrier staining when used in a two-component developer as a developer.

Patent document 1: Japanese Patent Application Publication (JP-A) No. 2009-210723

Patent document 2: JP-A No. 2009-200225

SUMMARY

The present invention was made in consideration of the above situations, and an object of the present invention is provide a toner which has low-temperature fixability and which can reduce the generation of the image defect resulting from photoreceptor filming. An object of the present invention is also to provide a production method of such toner. The above-described object of the present invention can be achieved by the following embodiments.

A toner of the present invention is characterized by containing a polyester resin which has a structure part represented by Formula (1).

Formula (1)

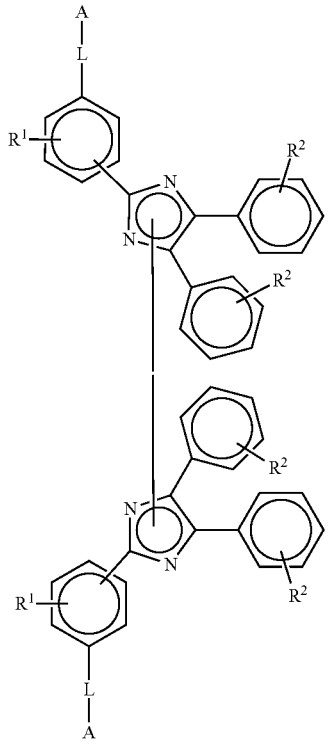

In Formula (1), "A" represents a polyester structure unit having at least one linking group; $R^1$ represents a hydrogen atom, or a chlorine atom; $R^2$ represents a hydrogen atom, a chlorine atom, or a methoxy group; and "L" represents a divalent organic group.

In the toner of the present invention, "L" in the aforesaid Formula (1) is preferably a group represented by any one of Formulas (a) to (d).

Formula (a)

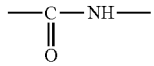

Formula (b)

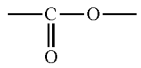

Formula (c)

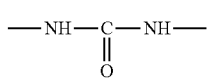

Formula (d)

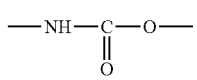

In the toner of the present invention, $R^1$ and $R^2$ in the aforesaid Formula (1) each are preferably a hydrogen atom.

In the toner of the present invention, the polyester structure unit represented by "A" in the aforesaid Formula (1) is preferably a unit containing a structure part derived from an unsaturated polycarboxylic acid.

The production method of the toner of the present invention is a production method of the toner for manufacturing the above-mentioned toner. It is characterized by having the following steps: (i) preparing a polyester prepolymer which has a triphenyl imidazole group introduced by a triphenyl imidazole compound represented by the following Formula (2); and then, (ii) reacting the polyester prepolymer which has the triphenyl imidazole group under existence of an oxidizing agent to obtain a polyester resin which has the structure part represented by the aforesaid Formula (1).

Formula (2)

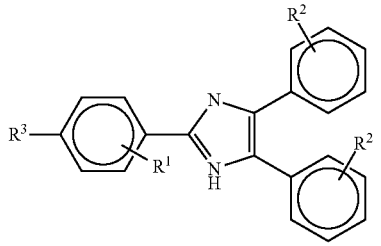

In Formula (2), $R^1$ represents a hydrogen atom, or a chlorine atom; $R^2$ represents a hydrogen atom, a chlorine atom, or a methoxy group; and $R^3$ represents an amino group, a hydroxyl group, a carboxyl group, or an isocyanate group.

In the production method of the toner of the present invention, one of the triphenyl imidazole compound represented by Formula (2) and the polyester prepolymer, both of which are used for preparing the polyester prepolymer having the triphenyl imidazole group in the molecule, has a group containing an active hydrogen atom. And the other has an isocyanate group or a carboxyl group. It is preferable that the triphenyl imidazole group is introduced in the polyester prepolymer by combining these two groups through reaction.

It is preferable that the production method of the toner of the present invention has one of the following features.

(1) Reacting a non-modified polyester prepolymer and a triphenyl imidazole compound represented by the following Formula (2-1) to obtain a polyester prepolymer having a triphenyl imidazole group and finally to obtain a polyester resin in which "L" in the aforesaid Formula (1) is represented by the aforesaid Formula (a).

Formula (2-1)

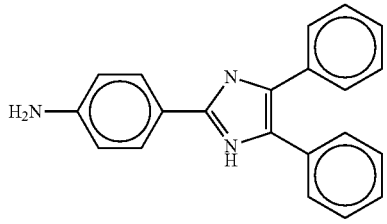

(2) Reacting an isocyanate modified polyester prepolymer and a triphenyl imidazole compound represented by the aforesaid Formula (2-1) to obtain a polyester prepolymer having a triphenyl imidazole group and finally to obtain a polyester resin in which "L" in the aforesaid Formula (1) is represented by the aforesaid Formula (c).

(3) Reacting a non-modified polyester prepolymer and a triphenyl imidazole compound represented by the following Formula (2-2) to obtain a polyester prepolymer having a triphenyl imidazole group and finally to obtain a polyester resin in which "L" in the aforesaid Formula (1) is represented by the aforesaid Formula (b).

Formula (2-2)

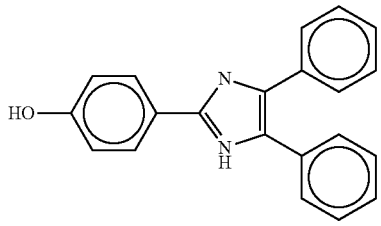

(4) Reacting an isocyanate modified polyester prepolymer and a triphenyl imidazole compound represented by the aforesaid Formula (2-2) to obtain a polyester prepolymer having a triphenyl imidazole group and finally to obtain a polyester resin in which "L" in the aforesaid Formula (1) is represented by the aforesaid Formula (d).

(5) Reacting a non-modified polyester prepolymer and a triphenyl imidazole compound represented by the following Formula (2-3) to obtain a polyester prepolymer having a triphenyl imidazole group and finally to obtain a polyester resin in which "L" in the aforesaid Formula (1) is represented by the aforesaid Formula (d).

Formula (2-3)

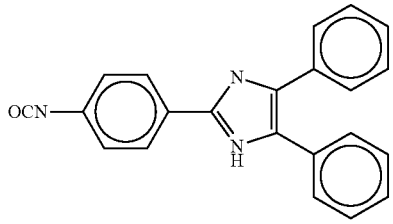

(6) Reacting an amino modified polyester prepolymer and a triphenyl imidazole compound represented by the aforesaid Formula (2-3) to obtain a polyester prepolymer having a triphenyl imidazole group and finally to obtain a polyester resin in which "L" in the aforesaid Formula (1) is represented by the aforesaid Formula (c).

(7) Reacting a non-modified polyester prepolymer and a triphenyl imidazole compound represented by the following Formula (2-4) to obtain a polyester prepolymer having a triphenyl imidazole group and finally to obtain a polyester resin in which "L" in the aforesaid Formula (1) is represented by the aforesaid Formula (b).

Formula (2-4)

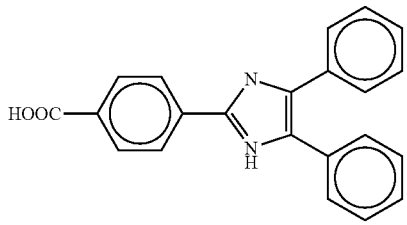

(8) Reacting an amino modified polyester prepolymer and a triphenyl imidazole compound represented by the aforesaid Formula (2-4) to obtain a polyester prepolymer having a triphenyl imidazole group and finally to obtain a polyester resin in which "L" in the aforesaid Formula (1) is represented by the aforesaid Formula (a).

In the toner of the present invention, a polyester resin which has a specific structure part is contained, and this polyester resin has the characteristics in that cleavage of the bond between the imidazole rings concerning the bond groups which combine the polyester structure units is carried out by receiving a pressure. As a result, sufficient resin strength, i.e., sufficient toner particle strength, is obtained before subjected to a fixing process, and at the same time, the resin will be changed into a low molecular resin immediately by the fixing pressure given in the fixing process. Therefore, while low temperature fixing can be acquired, there is no generation of an image defect over a long period of time, and a high quality image can be stably obtained.

According to the production method of the toner of the present invention, it can be easily obtained a toner which can produce a high quality image over a long period of time, while achieving low-temperature fixing property.

DESCRIPTION OF THE PREFERRED EMBODIMENTS

Hereafter, the present invention will be described specifically.

The toner of the present invention is composed of toner particles containing the polyester resin having a structure part represented by the above-mentioned Formula (1) (hereafter, this resin is also called as "a specific polyester resin").

The specific polyester resin is a resin having a divalent linking group of a specific structure (hereafter, this linking group is also called as "a specific linking group"). The specific polyester resin is a polymer of a composition in which a polyester structural unit is formed by combining with this specific linking group. Here, "a divalent linking group of a specific structure (a specific linking group)" has a structure which forms bonds at two ends of the linking bonds on the two benzene rings each respectively bonded with L in Formula (1).

The specific polyester resin includes a polymer having a composition of combining the polyester structure unit with the specific linking group, namely, by cross-linking or by molecular elongation. Specifically, cross-linking is a state in which the linking group (L in Formula (1)) is bonded to the side chain of a polyester structure unit (A in Formula (1)), and molecular elongation is a state in which there is a linking bond at the molecular end of a polyester structure unit (A in Formula (1)).

In Formula (1) representing the specific polyester resin, "A" is a polyester structure unit (it is also called as "a specific polyester structure unit") having one or more linking bonds. This specific polyester structure unit is preferably obtained by reaction of a polyol compound with a polycarboxylic acid compound.

Examples of a polyol compound include: divalent alcohols of aliphatic diols such as 1,2-propanediol, 1,3-propanediol, 1,4-butanediol, 1,5-pentanediol, 1,6-hexanediol, 1,7-heptanediol, 1,8-octanediol, neo-pentylglycol and 1,4-butenediol; and an aromatic diol such as an alkylene oxide adduct of bisphenol A, and three or more valent alcohols such as glycerin, pentaerythritol, trimethylolpropane and sorbitol. These may be used singly or may be used in combination with two or more.

Preferable polycarboxylic acid compounds used for obtaining the specific polyester structure unit are: fumaric acid, maleic acid, itaconic acid, terephthalic acid, isophthalic acid and trimellitic acid. In addition to them, there can be cited, for example: saturated aliphatic dicarboxylic acid such as oxalic acid, malonic acid, succinic acid, glutaric acid, adipic acid, sebacic acid, azelaic acid and n-dodecylsuccinic acid; and an alicyclic dicarboxylic acid such as cyclohexanedicarboxylic acid. These may be used singly or may be used in combination with two or more.

Among these, more preferably used polycarboxylic acid compounds are: fumaric acid, maleic acid, itaconic acid and terephthalic acid. Still more preferably used polycarboxylic acid compounds are fumaric acid, maleic acid and itaconic acid which are classified as an unsaturated polycarboxylic acid.

Specific examples of preferable specific polyester structure unit include compounds obtained by reaction of an alkylene oxide adduct of bisphenol A as a polyol compound; and fumaric acid, maleic acid or itaconic acid as a polycarboxylic acid compound.

In Formula (1), $R^1$ represents a hydrogen atom, or a chlorine atom, and preferably it is a hydrogen atom. The reasons of this are: (i) it is easy to obtain; and (ii) the amount of electrostatic charge of the obtained toner will become equivalent to that of the toner containing the resin composed of the specific polyester structure unit (polyester prepolymers into which the triphenyl imidazole group is introduced as a raw material for obtaining specific polyester resin). Moreover, when $R^1$ represents a chlorine atom, $R^1$ is preferably bonded at the para position with respect to the imidazole ring.

In Formula (1), $R^2$ represents a hydrogen atom, a chlorine atom, or a methoxy group, and preferably it is a hydrogen atom. The reasons of this are the same as those for $R^1$ in which a hydrogen atom is preferable. Moreover, when $R^2$ represents a chlorine atom, $R^2$ is bonded at any position of ortho, metha or para position with respect to the imidazole ring. Moreover, when $R^2$ represents a methoxy group, $R^2$ is preferably bonded at ortho, or metha position with respect to the imidazole ring.

In Formula (1), "L" represents a divalent organic group, and two pieces of "L" may be different, but preferably they are identical. As preferable examples of the divalent organic group represented by "L", the groups represented by the above-mentioned Formulas (a) to (d) are cited. The groups represented by Formulas (a) to (d) may be combined with a specific polyester structural unit via one of the two linking groups in Formulas (a) to (d).

In Formula (1), the imidazole ring in the specific linking group is preferably bonded to the para position of the benzene ring which supplies a linking group of the end of the specific linking group, with respect to "L" (a divalent organic group) to be bonded at the end of the specific linking group.

The specific polyester resin is preferably a resin containing at least one of a hydroxyl group and a carboxyl group at the end of the molecule. In addition, the specific polyester resin has preferably a composition in which the specific polyester structure unit is cross-linked with the specific linking group from the viewpoint of reducing the reaction time to obtain the specific polyester resin in a toner preparation process.

Since the specific polyester resin may be insoluble in tetrahydrofuran, it is not easy to measure its molecular weight directly. However, when a pressure is given to the specific polyester resin using an agate mortar to cleave the bonds between imidazole rings, the specific polyester resin in this cleaved state will be dissolved in tetrahydrofuran. As for the number average molecular weight of the styrene conversion measured by gel permeation chromatography (GPC), in this state, it is desirable that it is 3,000 to 12,000.

Molecular weight determination via GPC for the specific polyester resin in the state of cleaved bond between imidazole rings is carried out as follows: namely, using apparatus "HLC-8220" (produced by Tosoh Corp.) and column "TSK guard column+TSK gel Super HZM-M (three in series)" (produced by Tosoh Corp.), as the column temperature is kept at 40° C., tetrahydrofuran (THF) as a carrier solvent is passed at a flow rate of 0.2 ml/min, and a measurement sample (the specific polyester resin sample subjected to cleavage treatment of the imidazole ring bond) is dissolved in tetrahydrofuran so that the concentration thereofbecomes 1 mg/ml under a condition in that dissolution is carried out using an ultrasonic dispersing device at room temperature for 5 minutes. Then a sample solution is obtained via treatment of a membrane filter of a 0.2 μm pore size, and 10 μl thereof is injected into the above apparatus along with the carrier solvent for detection using a refractive index detector (RI detector). From the molecular weight distribution of the measured sample, molecular weight can be determined.

Here, "the cleaving treatment of the bonds between imidazole rings" is a treatment which applies pressure to 30 g of the specific polyester resin in an automatic agate mortar "AMM-140D/KN3324014" (made by Tech Jam, Co., Ltd.) under the conditions of room temperature with a rotating speed of 100 rpm of an agate pestle to give a pressure for 10 minutes.

The glass transition temperature of the specific polyester resin is preferably 48 to 56° C.

When the glass transition temperature of the specific polyester resin is within the above-described range, both low temperature fixability and high thermal storage stability of the obtained toner can be achieved. Furthermore, it can be controlled the appearance of photoreceptor filming, namely, it can be suppressed the image defect which is originated from the appearance of photoreceptor filming.

Herein, the glass transition temperature (Tg) of the specific polyester resin is determined using differential scanning calorimeter "DSC-7" (produced by Perkin Elmer, Inc.) and thermal analyzer controller "TAC7/DX" (produced by Perkin Elmer, Inc.). Specifically, 4.50 mg of the specific polyester resin is sealed in an aluminum pan (Kit No. 0219-0041) and placed in a DSC-7 sample holder. An empty aluminum pan is used as the reference measurement. Subsequently, heating-cooling-heating temperature control is carried out over a measurement temperature range of 0 to 200° C. under measurement conditions of a temperature increasing rate of 10° C./min and a temperature decreasing rate of 10° C./min. Measured data is obtained during the second heating stage, and then a glass transition temperature (Tg) is obtained as a value which is read at the intersection of the extension of the base line, prior to the initial rise of the first endothermic peak, with the tangent showing the maximum inclination between the initial rise of the first endothermic peak and the peak summit Incidentally, during the first temperature increase, temperature is kept at 200° C. for 5 minutes.

The above-described specific polyester resin constitutes so-called a binder resin of the toner of the present invention. This specific polyester resin can be used independently or may be used in combination with well-known resins (hereafter, they are also called "other toner resin") other than the specific polyester resin concerned.

When toner binder resin component is composed of the specific polyester resin and other toner resin, the content of the specific polyester resin in the toner binder resin component is preferably 50 weight % or more.

[Other Toner Resin]

As other toner resin, resins which exhibit a high elastic modulus at the time of melting can be used auxiliary. Examples of other toner resin are: a vinyl resin such as a styrene acrylic resin; a polyurethane resin; and a styrene-butadiene resin.

The toner of the present invention may contain additives such as a colorant, a charge controlling agent, a magnetic particle and a releasing agent, if needed.

[Colorant]

As a colorant, various types of organic or inorganic pigments having various colors can be used as illustrated below.

Black pigments: Carbon black and iron oxide

Yellow pigments Naphthol Yellow S, Hansa Yellow G, Hansa Yellow 10G, Quinoline Yellow Lake, Permanent Yellow NCG and Tartrazine Lake Orange pigments: Indathrene Brilliant Orange RK and Indathrene Brilliant Orange GK Red pigments: Quinacridone, Colcothar, Permanent Red 4R, Lithol Red, Pyrazolone Red, Watching Red, Calcium salt, Lake Red C, Lake Red D, Brilliant Carmine 6B, Eosine Lake, Rhodamine Lake B, Alizarin Lake and Brilliant Carmine 3B Purple pigments: Fast violet B and Methyl Violet Lake Blue pigments: Berlin Blue, Cobalt Blue, Alkali Blue Lake, Victoria Blue Lake, Metal Phthalocyanine Blue, Non-metal Phthalocyanine Blue, Phthalocyanine Blue partially chlorinated, Fast Sky Blue and Indathrene Blue BC Green pigments: Pigment Green B, Malachite Green Lake and Final Yellow Green G White pigments: Zinc white, Titanium oxide, Antimony White and Zinc Sulfide.

Moreover, as an extender, a baryta powder, barium carbonate, clay, silica, white carbon, talc, an alumina white, etc. are cited. These pigments can be used singly or can be used in combination of two or more sorts.

The content ratio of a colorant is preferably 0.5 to 20 weight % with respect to the whole toner, and it is more preferably 2 to 10 weight %.

[Magnetic Particle]

As a magnetic particle, magnetite, γ-hematite, or various ferrites can be used, for example. The content ratio of a magnetic particle is preferably 10 to 500 weight % with respect to the whole toner, and it is more preferably 20 to 200 weight %.

[Charge Controlling Agent]

As a charge controlling agent, it is not limited especially if it is the substance which can give positive or negative charge by triboelectric charging. Various well-known positive charge controlling agents and negative charge controlling agents can be used.

Specific examples of a positive charge controlling agent include: Nigrosine dye such as "Nigrosine Base EX" (made by Orient Chemical Industries, Co., Ltd.), quaternary ammonium salt such as "Quaternary ammonium salt A-51" (made by Orient Chemical Industries, Co., Ltd.) and "Copy Charge AX VA435" (made by Hoechst Japan, Co., Ltd.), alkoxyamine, alkylamide, molybdic acid chelate pigment, and imidazole compound such as "ALZ1001" (made by Shikoku Chemicals Co., Ltd.)

As a negative charge controlling agent, it can be used various types of compounds including a metal complex such as: Bontron S-22, Bontron S-34, Bontron S-22, Bontron S-81 and Bontron S-84 (made by Orient Chemical Industries, Co., Ltd.), and Spironblack THR (made by Hodogaya Chemical, Co., Ltd.)

The content ratio of a charge controlling agent in the toner is preferably 0.1 to 10 weight % with respect to the whole toner.

[Releasing Agent]

It can be used various well-known waxes as a releasing agent. Examples of a wax preferably used are: a low molecular weight polypropylene, polyethylene, paraffin wax, microcrystaline wax, Fischer Tropsch wax and fatty acid ester wax.

The content ratio of a releasing agent in the toner is preferably 0.1 to 30 weight % with respect to the whole toner, and it is more preferably 4 to 15 weight %.

[External Additive]

In the toner of the present invention, external additives such as a lubricant and a cleaning aid may be added in order to improve fluidity, electrostatic property and cleaning property.

Examples of an external additive include inorganic particles such as: inorganic oxide particles of silica, alumina and titanium oxide; inorganic stearic acid compound particles of aluminum stearate and zinc stearate; and inorganic titanic acid compound particles of strontium titanate and zinc titanate.

These inorganic particles are preferably subjected to a surface treatment using a silane coupling agent, a titanium coupling agent, a higher fatty acid, or a silicone oil, from the viewpoints of improving thermal storage stability and environmental stability.

The content ratio of an external additive in the toner is preferably 0.05 to 5 weight % parts with respect to the whole toner, and it is more preferably 0.1 to 3 weight %. It may be used various types of external additives by combining various types of additives.

[Production Method of Toner]

The production method of the toner of the present invention is characterized by having the following steps: (i) preparing a polyester prepolymer which has a triphenyl imidazole group introduced by a triphenyl imidazole compound represented by the following Formula (2), (the aforesaid polyester prepolymer is also called as "a triphenyl imidazole group containing prepolymer" and the aforesaid triphenyl imidazole compound is also called as "a specific triphenyl imidazole compound"); and (ii) reacting the triphenyl imidazole group containing prepolymer under existence of an oxidizing agent to obtain a polyester resin which has the structure part represented by the aforesaid Formula (1). The method including steps (i) and (ii) is also called as "a production method of the specific polyester resin".

The production method of the specific polyester resin is a method to prepare a resin to form a binder resin. In the first synthetic step, a polyester prepolymer which is used as a raw material to introduce a triphenyl imidazole group (it is called as "a raw material polyester prepolymer", or it is called as "a non-modified polyester prepolymer") and a specific triphenyl imidazole compound are allowed to react to prepare a triphenyl imidazole group containing prepolymer. Then, in the second synthetic step, the prepared triphenyl imidazole group containing prepolymer is allowed to react under existence of an oxidizing agent, thereby the imidazole rings between the triphenyl imidazole group containing prepolymers are bonded to produce the specific polyester resin which is a compound represented by Formula (1).

As a raw material polyester prepolymer used in the first synthetic step, a well-known polyester resin can be used.

As a raw material polyester prepolymer, it is preferable that the molecular weight is 3,000 to 12,000 in the number average molecular weight of the styrene conversion measured by gel permeation chromatography (GPC).

A preferable example of raw material polyester prepolymer is a compound obtained by carrying out a polycondensation reaction of a polyol compound and a polyvalent carboxylic acid compound under the condition of an inert gas atmosphere at a temperature of 120 to 250° C. using a well-known esterification catalyst if needed. In addition, it may be non-modified and modified.

Such raw material polyester prepolymers have functional groups, such as a hydroxyl group originated from the polyol compound and/or a carboxyl group originated from the polyvalent carboxylic acid compound, and further a substituent introduced thereinto by modification. When it is intended to obtain a polymer having a composition of a cross linkage through the specific bonding group as a specific polyester resin, it is preferable that a functional group is located at a position other than an end position of the molecule. On the other hand, when it is intended to obtain a polymer having a composition of molecular extension by combing the polyester units via the specific bonding group as a specific polyester resin, it is preferable that a functional group is located at an end position of the molecule.

A preferable method to prepare a raw material polyester prepolymer having a functional group at a position other than an end position of the molecule is as follows. By using three or more valent alcohol and carboxylic acid in addition to divalent alcohol and carboxylic acid, at first, only divalent compounds are allowed to react. And after making these react to some extent, three or more valent compounds are added into the reaction system.

Preferable examples of a modified polyester resin include: an isocyanate modified polyester resin which has an isocyanate group and an amino modified polyester resin which has an amino group.

An isocyanate modified polyester resin can be prepared as follows: carrying out polycondensation reaction of a polyvalent carboxylic acid compound and a polyol compound to produce a polyester rein; then the produced polyester rein (non-modified polyester resin) having a group provided with an active hydrogen atom (an active hydrogen atom group) is made to react with a polyvalent isocyanate compound (isocyanate modification reaction).

Here, examples of an active hydrogen atom group relating to a non-modified polyester resin include: a hydroxyl group (an alcoholic hydroxyl group), an amino group and a carboxyl group. Among these, most preferable is a hydroxyl group (an alcoholic hydroxyl group).

Examples of a polyvalent isocyanate compound include: aliphatic poly isocyanates (for example, tetramethylene diisocyanate, hexamethylene diisocyanate and 2,6-diisocyanato methyl caproate); alicyclic polyisocyanates (for example, isophorone diisocyanate and cyclohexylmethane diisocyanate); aromatic diisocyanates (for example, tolylene diisocyanate and diphenylmethane diisocyanate); aroaliphatic diisocyanates (for example, α, α, α', α'-tetramethylxylylene diisocyanate); compounds obtained by blocking isocyanurates, the aforesaid alicyclic polyisocyanates, or the aforesaid alicyclic polyisocyanate with a phenol derivative, oxime, or caprolactam. These may be used singly or may be used in combination with two or more.

Usually, the amount of used polyvalent isocyanate is in such a manner that the molar ratio of [NCO]/[OH] being between 5/1 and 1/1, more preferably between 2.5/1 and 1.5/1. Here, [NCO] indicates an amount of an isocyanate group, and [OH] indicates an amount of a hydroxyl group of a non-modified polyester resin.

When the amount of the polyvalent isocyanate compound used is excessive, there may be induced decreased thermal storage stability (blocking resistance) which is originated from the polyvalent isocyanate compound which will remain and exist in the toner without being consumed in a reaction with a non-modified polyester resin (isocyanate modification reaction).

On the other hand, when the amount of the polyvalent isocyanate compound used is too small, the amount of isocyanate groups in the obtained isocyanate modified polyester resin will be small, as a result, it becomes impossible to fully form a bonding structure by the specific bonding groups in the specific polyester resin finally obtained. And, there is a possibility that an image density or the toner density in a developer may become unstable, which is originated from the increased humidity dependence of the triboelectric charging nature of the toner.

In an isocyanate modified polyester resin as a raw material polyester prepolymer, the content of the isocyanate group per molecule is usually one or more, and preferably it is 1.5 to 2.

An amino modified polyester resin can be obtained by making a reaction of a polyester resin (non-modified polyester resin), which is obtained by carrying out a polycondensation reaction of a polycarboxylic acid compound and a polyol compound, with an amine compound.

There are two types of amino modified polyester resins. One of them has a composition in which an amino group is introduced at the end position of the molecule. The other has a composition in which an amino group is introduced at other position than the end position of the molecule, i.e., in the main chain of the molecule. An amino modified polyester resin having been introduced an amino group at the end position can be obtained by using an amine compound having a functional group which can react with an alcohol residue (a hydroxyl group) originated from a polyol compound in a non-modified polyester resin (this amine compound is also called as "amine compound (a)"). However, from the viewpoint of reaction easiness, it is more suitable to use an amine compound having a functional group which can react with a carboxylic residue (a carboxylic group) originated from a polycarboxylic compound in a non-modified polyester resin (this amine compound is also called as "amine compound (b)"). Moreover, an amino modified polyester resin having been introduced an amino group at other position than the end position can be obtained by using an amine compound having a functional group which can react with a carboxylic residue (a carboxylic group) originated from a polycarboxylic compound in a non-modified polyester resin (this amine compound is also called as "amine compound (b-1)").

The aforesaid amine compound (a) includes an amino carboxylic acid, i.e., an amino acid. Specific examples are: aminopropionic acid, aminocaproic acid, arginine, aspartic acid, glutamine, glutamic acid, glycine, alanine and phenylalanine.

The aforesaid amine compound (b) and amine compound (b) include a hydroxylamine, i.e., an aminoalcohol, or a polyamine compound. Specific examples of a hydroxyl amine are: aminoethanol, N-methyl-2-aminoethanol, N,N-dimethyl-2-aminoethanol, N-ethyl-2-aminoethanol, N,N-diethyl-2-aminoethanol,N-methyl-N-ethyl-2-aminoethanol, 3-amino-1-propanol, 3-methylamino-1-propanol, 3-dimethylamino-1-propanol, 1-dimethylamino-2-propanol, 3-diethylamino-1-propanol, 1-diethylamino 2-propanol and 3-dimethylamino 2,2-dimethyl-1-propanol.

Among these, N,N-dimethyl-2-aminoethanol is preferable from the viewpoints of reactivity and easiness to acquire.

Examples of a polyamine compound for the aforesaid amine compound (b-1) include: aromatic diamines such as phenylenediamine, diethyltoluenediamine and 4,4'-diaminodiphenylmethane; alicyclic diamines such as 4,4'-diamino-3,3'-dimethyldicyclohexylmethane, diamine cyclohexane and isophoronediamine; aliphatic series diamines such as ethylenediamine, tetramethylenediamine and hexamethylenediamine; and polyvalent amine having 3 or more values such as diethylenetriamine and triethylenetetramine. Among them, isophoronediamine is most preferable since it has high reactivity.

In Formula (2) which represents a specific triphenyl imidazole compound used in the first synthetic step, $R^3$ represents an amino group, a hydroxyl group, a carboxyl group, or an isocyanate group.

Preferable examples of a specific triphenyl imidazole compound are triphenyl imidazole compounds represented by any one of the aforesaid Formulas (2-1) to (2-4).

Here, the triphenyl imidazole compounds represented by the aforesaid Formulas (2-1) to (2-4) can be prepared with a conventional method.

Specifically, a triphenyl imidazole compound represented by Formula (2-1) can be synthesized as follows: first, 4,5-diphenyl-2-(3-nitrophenyl)-1H-imidazole is obtained by reaction of benzoin, 3-nitrobenzaldehyde, ammonium acetate and 1-butylimidazolium tetrafluoroborate. Then, the obtained 4,5-diphenyl-2-(3-nitrophenyl)-1H-imidazole in ethanol is subjected to hydrogenation treatment under existence of catalyst composed of palladium on charcoal.

A triphenyl imidazole compound represented by Formula (2-1) can be synthesized as follows: first, 1-butylimidazolium tetrafluoroborate is obtained by reacting 1-butylimidazole with tetrafluoroboric acid. Then, the obtained 1-butylimidazolium tetrafluoroborate, benzoin, 3-hydroxybenzaldehyde, and ammonium acetate are made to react.

In a reaction system of a raw material polyester prepolymer and a specific triphenyl imidazole compound relating to the first synthetic step, the amount of the specific triphenyl imidazole compound used in the reaction is preferably 1 to 100 weight % with respect to the raw material polyester prepolymer.

The reaction of the raw material polyester prepolymer with the specific triphenyl imidazole compound is carried out under the conditions of the reaction temperature of about 100 to 220 ° C. and the reaction time of about 0.5 to 2 hours.

Examples of an oxidizing agent used in the second synthetic step include: potassium ferricyanide, potassium permanganate, potassium chlorate, potassium bromate and sodium bromate. Among these, potassium ferricyanide is most preferably used.

The used amount of an oxidizing agent is preferably 2 to 60 mol equivalents with respect to a triphenyl imidazole group in the triphenyl imidazole group containing prepolymer.

Moreover, the conditions of the bonding reaction between the imidazole rings in the triphenyl imidazole group containing prepolymer are: the reaction temperature is about 5 to 15° C., and the reaction time is about 2 to 8 hours.

In the synthetic process of the specific polyester resin, it is preferable that one of the raw material polyester prepolymer and the specific triphenyl imidazole compound, which are used in the first synthetic step, has a group containing an active hydrogen atom (active hydrogen group), and the other has an isocyanate group or a carboxyl group. By selecting the raw material polyester prepolymer and the specific triphenyl imidazole compound which are used in the first synthetic step as described above, a triphenyl imidazole group will be introduced in the polyester prepolymer by the bonding reaction (condensation reaction or addition reaction) of the active hydrogen group and the isocyanate group or the carboxyl group.

Hereafter, examples of the synthetic process of the specific polyester resins will be shown in the following synthetic example (1) to (8).

Here, Synthetic examples (1) and (2) each are examples to obtain a specific polyester resin having L in Formula (1) is represented by Formula (a). Synthetic examples (3) and (4) each are examples to obtain a specific polyester resin having L in Formula (1) is represented by Formula (b). Synthetic examples (5) and (6) each are examples to obtain a specific polyester resin having L in Formula (1) is represented by Formula (c). Synthetic examples (7) and (8) each are examples to obtain a specific polyester resin having L in Formula (1) is represented by Formula (d).

SYNTHETIC EXAMPLES(1)

First, in the first synthetic step, a non-modified polyester resin (as a raw material polyester prepolymer) and a triphenyl imidazole compound represented by Formula (2-1) (as a specific triphenyl imidazole compound) are reacted. By this reaction, a carboxyl group in the non-modified polyester resin and an amino group in the triphenyl imidazole compound represented by Formula (2-1) are combined. As a result, the bonding portion formed by combination of the carboxyl group and the amino group, namely, the bonding portion having the structure represented by Formula (a) is formed.

Thus, a triphenyl imidazole group is introduced in the raw material polyester prepolymer to obtain a triphenyl imidazole group containing prepolymer.

Next, in the second synthetic step, after carrying out the combining reaction of the imidazole rings between the triphenyl imidazole group containing prepolymers, two triphenyl imidazole group containing prepolymers are bonded through the specific bonding group. As a result, a polyester resin having L in Formula (1) is represented by Formula (a) is obtained as a specific polyester resin.

SYNTHETIC EXAMPLES(2)

First, in the first synthetic step, an amino modified polyester resin (as a raw material polyester prepolymer) and a triphenyl imidazole compound represented by Formula (2-4) (as a specific triphenyl imidazole compound) are reacted. By this reaction, an amino group in the amino modified polyester resin and a carboxyl group in the triphenyl imidazole compound represented by Formula (2-4) are combined. As a result, the bonding portion having the structure represented by Formula (a) is formed. Thus, a triphenyl imidazole group is introduced in the raw material polyester prepolymer to obtain a triphenyl imidazole group containing prepolymer.

Next, in the second synthetic step, after carrying out the combining reaction of the imidazole rings between the triphenyl imidazole group containing prepolymers, two triphenyl imidazole group containing prepolymers are bonded through the specific bonding group. As a result, a polyester resin having L in Formula (1) is represented by Formula (a) is obtained as a specific polyester resin.

SYNTHETIC EXAMPLES(3)

First, in the first synthetic step, a non-modified polyester resin (as a raw material polyester prepolymer) and a triphenyl imidazole compound represented by Formula (2-2) (as a specific triphenyl imidazole compound) are reacted. By this reaction, a carboxyl group in the non-modified polyester resin and a hydroxyl group in the triphenyl imidazole compound represented by Formula (2-2) are combined. As a result, the bonding portion formed by combination of the carboxyl group and the hydroxyl group, namely, the bonding portion having the structure represented by Formula (b) is formed. Thus, a triphenyl imidazole group is introduced in the raw material polyester prepolymer to obtain a triphenyl imidazole group containing prepolymer.

Next, in the second synthetic step, after carrying out the combining reaction of the imidazole rings between the triphenyl imidazole group containing prepolymers, two triphenyl imidazole group containing prepolymers are bonded through the specific bonding group. As a result, a polyester resin having L in Formula (1) is represented by Formula (b) is obtained as a specific polyester resin.

SYNTHETIC EXAMPLES(4)

First, in the first synthetic step, a non-modified polyester resin (as a raw material polyester prepolymer) and a triphenyl imidazole compound represented by Formula (2-4) (as a specific triphenyl imidazole compound) are reacted. By this reaction, a hydroxyl group in the non-modified polyester resin and a carboxyl group in the triphenyl imidazole compound represented by Formula (2-4) are combined. As a result, the bonding portion having the structure represented by Formula (b) is formed. Thus, a triphenyl imidazole group is introduced in the raw material polyester prepolymer to obtain a triphenyl imidazole group containing prepolymer.

Next, in the second synthetic step, after carrying out the combining reaction of the imidazole rings between the triphenyl imidazole group containing prepolymers, two triphenyl imidazole group containing prepolymers are bonded through the specific bonding group. As a result, a polyester resin having L in Formula (1) is represented by Formula (b) is obtained as a specific polyester resin.

SYNTHETIC EXAMPLES(5)

First, in the first synthetic step, an isocyanate modified polyester resin (as a raw material polyester prepolymer) and a triphenyl imidazole compound represented by Formula (2-1) (as a specific triphenyl imidazole compound) are reacted. By this reaction, an isocyanate group in the isocyanate modified polyester resin and an amino group in the triphenyl imidazole compound represented by Formula (2-1) are combined. As a result, the bonding portion formed by combination of the isocyanate group and the amino group, namely, the bonding portion having the structure represented by Formula (c) is formed. Thus, a triphenyl imidazole group is introduced in the raw material polyester prepolymer to obtain a triphenyl imidazole group containing prepolymer.

Next, in the second synthetic step, after carrying out the combining reaction of the imidazole rings between the triphenyl imidazole group containing prepolymers, two triphenyl imidazole group containing prepolymers are bonded through the specific bonding group. As a result, a polyester resin having L in Formula (1) is represented by Formula (c) is obtained as a specific polyester resin.

SYNTHETIC EXAMPLES(6)

First, in the first synthetic step, an amino modified polyester resin (as a raw material polyester prepolymer) and a triphenyl imidazole compound represented by Formula (2-3) (as a specific triphenyl imidazole compound) are reacted. By this reaction, an amino group in the amino modified polyester resin and an isocyanate group in the triphenyl imidazole compound represented by Formula (2-3) are combined. As a result, the bonding portion having the structure represented by Formula (c) is formed. Thus, a triphenyl imidazole group is introduced in the raw material polyester prepolymer to obtain a triphenyl imidazole group containing prepolymer.

Next, in the second synthetic step, after carrying out the combining reaction of the imidazole rings between the triphenyl imidazole group containing prepolymers, two triphenyl imidazole group containing prepolymers are bonded through the specific bonding group. As a result, a polyester resin having L in Formula (1) is represented by Formula (c) is obtained as a specific polyester resin.

In addition, in this synthetic example, the obtained specific polyester resin will have a urea bond at the introduction portion of the triphenyl imidazole group formed by the amino group in the amino modified polyester resin and the isocyanate group in the triphenyl imidazole compound represented by Formula (2-3). As a result, the obtained specific polyester resin is named as a urea modified polyester resin.

SYNTHETIC EXAMPLES(7)

First, in the first synthetic step, an isocyanate modified polyester resin (as a raw material polyester prepolymer) and a triphenyl imidazole compound represented by Formula (2-2) (as a specific triphenyl imidazole compound) are reacted. By this reaction, an isocyanate group in the isocyanate modified polyester resin and a hydroxyl group in the triphenyl imidazole compound represented by Formula (2-2) are combined. As a result, the bonding portion formed by combination of the isocyanate group and the hydroxyl group, namely, the bonding portion having the structure represented by Formula (d) is formed. Thus, a triphenyl imidazole group is introduced in the raw material polyester prepolymer to obtain a triphenyl imidazole group containing prepolymer.

Next, in the second synthetic step, after carrying out the combining reaction of the imidazole rings between the triphenyl imidazole group containing prepolymers, two triphenyl imidazole group containing prepolymers are bonded through the specific bonding group. As a result, a polyester resin having L in Formula (1) is represented by Formula (d) is obtained as a specific polyester resin.

In addition, in this synthetic example, the obtained specific polyester resin will have a urethane bond at the introduction portion of the triphenyl imidazole group formed by the isocyanate group in the isocyanate modified polyester resin and the hydroxyl group in the triphenyl imidazole compound represented by Formula (2-2). As a result, the obtained specific polyester resin is named as a urethane modified polyester resin.

SYNTHETIC EXAMPLES(8)

First, in the first synthetic step, a non-modified polyester resin (as a raw material polyester prepolymer) and a triphenyl imidazole compound represented by Formula (2-3) (as a specific triphenyl imidazole compound) are reacted. By this reaction, a hydroxyl group in the non-modified polyester resin and an isocyanate group in the triphenyl imidazole compound represented by Formula (2-3) are combined. As a result, the bonding portion having the structure represented by Formula (c) is formed. Thus, a triphenyl imidazole group is introduced in the raw material polyester prepolymer to obtain a triphenyl imidazole group containing prepolymer.

Next, in the second synthetic step, after carrying out the combining reaction of the imidazole rings between the triphenyl imidazole group containing prepolymers, two triphenyl imidazole group containing prepolymers are bonded through the specific bonding group. As a result, a polyester resin having L in Formula (1) is represented by Formula (d) is obtained as a specific polyester resin.

In a preparation method of a toner containing a synthetic process of such specific polyester resin as described above, it is suitable to carry out the synthesis of the specific polyester resin and formation of the toner in an aqueous medium. Specifically, it can be used a suspension polymerization method and an emulsion aggregation method. By adopting these methods, it can be avoided the cleavage of the bond between the imidazole rings of the specific bonding group to result in obtaining a toner containing the compounds in which this bond is sufficiently remained.

In addition, in the toner manufactured by what is called a pulverized method, there is a possibility that the cleavage of bonding between the imidazole rings of the specific bonding group may occur by the applied external force during a knead process in a manufacturing process.

Here, "an aqueous medium" indicates a medium containing water as a main component (50 weight % or more) in the total medium. As a component other than water, an organic solvent which dissolves in water can be cited. Examples of an organic solvent include: methanol, ethanol, isopropanol, butanol, acetone, methyl ethyl ketone and tetrahydrofuran.

Among these, especially an alcoholic organic solvent such as methanol, ethanol, isopropanol and butanol are preferable because they are an organic solvent which do not dissolve the resin.

[Size of Toner Particles]

The particle size of the toner particles composing the toner of the present invention is preferably 4 to 10 μm in a volume-based median diameter, it is more preferably 6 to 9 μm. When the particle size in a volume-based diameter is in the above-mentioned extent, transfer efficiency of the toner particles becomes high and the image quality of halftone is improved. At the same time, since deformation of toner particles will fully be made with a fixation pressure, the cleavage of bonding of a bis imidazole part (binding between the imidazole rings concerning the specific bonding group) will be advanced easily, and it is advantageous to realizing a low temperature fixing.

The volume-based median particle diameter of the toner is measured and calculated using a device constituted of "Coulter Multisizer III" (produced by Beclanan Coulter, Inc.) and a data processing computer system (produced by Beckman Coulter, Inc.) connected thereto.

Specifically, 0.02 g of the toner is added in 20 ml of a surfactant solution (being a surfactant solution prepared, for example, via ten-fold dilution of a neutral detergent containing a surfactant component with purified water to disperse a toner), followed by being wetted and then subjected to ultrasonic dispersion for 1 minute to prepare a toner dispersion. The toner dispersion is injected into a beaker, containing electrolyte solution "ISOTON II" (produced by Beckman Coulter, Inc.), set on the sample stand, using a pipette until the concentration indicated by the measuring apparatus reaches 5 to 10%. Herein, this concentration range makes it possible to obtain highly reproducible measurement values. Using the measuring apparatus, under conditions of a measured particle count number of 25,000 and an aperture diameter of 50 μm, the frequency is calculated by dividing a measurement range of 1 to 30 μm into 256 parts, and the particle diameter at a 50% point from the higher side of the volume accumulation ratio (namely the volume $D_{50}$% diameter) is designated as the volume-based median diameter.

(Average Circularity of Toner Particles)

The toner particles of the present invention preferably exhibit an average circularity of 0.930 to 1.000, more preferably from 0.950 to 0.995 from the viewpoint of enhancing transfer efficiency. The average circularity is an average value of circularity indicated by the following Equation (T).

Equation (T)

Circularity T={(circumference of a circle having an area equivalent to the projected area of a particle)/(a circumference of the projected particle)}.

(Developer)

The toner of the present invention can be used as a magnetic or non-magnetic single-component toner, or it can be used as a double-component developer by mixing with a carrier. When the toner of the present invention is used as a double-component developer, as the carrier constituting the double-component developer, there may be utilized magnetic particles composed of materials conventionally known in the art including ferromagnetic metals such as iron, alloys of a ferromagnetic with aluminium or lead, ferromagnetic metal compounds such as ferrite and magnetite. Specifically, ferrite particles are preferable.

As the carrier, there can be utilized a coated carrier prepared by coating the magnetic particles with a resin, or a resin dispersion type carrier (a binder type carrier) prepared by dispersing magnetic particles in a resin. A resin composition for such coating is not specifically limited. Examples of a resin constituting the coated carrier include: an olefin based resin, a styrene based resin, a styrene-acryl based resin, a silicone based resin, an ester based resin, and a fluorine-containing resin. A resin constituting the resin dispersion type carrier is not also specifically limited, and any of those known in the art may be utilized, including, for example, a styrene-acryl based resin, a polyester resin, a fluorine-containing resin and a phenol resin.

The volume-based median diameter of the carrier is preferably 20 to 100 μm, it is more preferably 20 to 60 μm. It is possible to determine the volume-based median diameter of a carrier using laser diffraction system particle size distribution meter "HELOS" (produced by SYMPATEC Co.) provided with a wet type dispersing apparatus.

According to the toner of the present invention, it contains a specific polyester resin provided with a specific structure part as a bonder resin. This specific polyester resin has the characteristics in that the specific bonding group between the imidazole rings concerning the specific bonding group is cleaved by receiving a pressure. By the cleavage of this bond, the coefficient of elasticity and the viscosity of the specific polyester resin will be decreased to the state which can be fixed. As a result, low-temperature fixing can be achieved and, at the same time, it can be prevented an image defect caused by the appearance of photoreceptor filming and a high quality image can be obtained.

Therefore, in the toner image fixing process in the image formation process using the toner of the present invention, it can be obtained a high quality visible image under the high-speed fixing condition of a fixing line speed of about 300 mm/second, and even at the low fixing temperature of 140° C. or less. Moreover, the obtained visible image will have sufficient folding fixability.

Since, the polyester structure unit constituting the specific polyester resin contains a structure portion derived from an unsaturated carboxylic acid, specifically, derived from fumaric acid, maleic acid or itaconic acid, further low-temperature fixing can be achieved. In addition, the structure portion derived from an unsaturated carboxylic acid structure will efficient to improve the strength of the fixed image and to prevent an image defect caused by sticking of two side image prints. The reasons are considered as follows.

The radical generated by the cleavage of the bond of the bis imidazole portion (the bond between the imidazole rings concerning the specific bonding group) will attack the double bond of the structure portion derived from an unsaturated carboxylic acid to produce a new cross-linking structure. Consequently, the melt-fixed toner image will be cured. Therefore, even if the fixing temperature is lowered, the toner image having high strength can be obtained and it is assumed to prevent an image defect caused by sticking of two side image prints. Usually, in heat pressing fixation of an electrophotographic method, the time for a toner image to contact a fixation component is more than 20 milliseconds. The time required for a radical to generate by the cleavage of the bond of the bis imidazole portion is about I millisecond. And the time required for the radical to react with the double bond in the structure portion derived from an unsaturated carboxylic acid is assumed to be less than 20 milliseconds under the condition at a fixing temperature. It is not unreasonable that the above-described effect will be produced during a usual heat pressing fixation.

From the viewpoints of accelerating the reaction between the radical and the unsaturated carboxylic acid, the content of the unsaturated carboxylic acid used for obtaining the specific structure unit is preferably 5 to 90 weight % with respect to the total weight of the monomers, and more preferably, it is 20 to 60 weight %.

The toner of the present invention is excellent in powder strength (more precisely, it has sufficient particle strength) in the state of before being subjected to the fixing process because the resin constituting the binder resin is formed by combining the polyester structure units with the specific binding group. On the other hand, during the fixing process, the binder resin will be changed to a low-molecular resin for the first time. Consequently, both of realization of the low-temperature fixability and the prevention of photoreceptor filming, which are conventionally supposed antinomy, can be attained.

The above-described toner of the present invention can be easily prepared using a method for producing the toner of the present invention which contains a synthetic process in which the specific polyester resin is synthesized as follows. At first, a triphenyl imidazole group containing prepolymer is prepared by reacting a raw material polyester prepolymer with a specific triphenyl imidazole compound. Then the prepared triphenyl imidazole group containing prepolymer is reacted under existence of an oxidizing agent

[Image Forming Method]

The toner of the present invention is used for an electrophotographic image forming method. In this method, an electrostatic latent image formed on a photoreceptor is developed to form a toner image, then, this toner image is transferred to an image supporting material, after that, the transferred image of the image supporting material is subjected to a fixing process to obtain a fixed toner image on the image supporting material as a visible image. The toner of the present invention is preferably used for the image forming method using a heat pressure fixing method in which both heat and pressure are applied as a fixing treatment in the toner fixing process of the image forming process.

In the image forming process using the heat pressure fixing method, since the toner of the present invention has a property of low-temperature fixability, it can be set the fixing temperature in the image forming apparatus to be relatively low as 80 to 140° C., more preferably 80 to 130 ° C. on the surface of the heating member at the fixing nip portion under the condition of a fixing line speed of less than 300 mm/second. Although it is needless to say that the toner of the present invention can be used under the condition of a fixing line speed of 300 mm/second or more, in order to control the fixing temperature in the above-described range, it is possible to use the toner by adjusting the nip width to be 20 to 50 mm with a general belt fixing method in a high speed image forming apparatus.

It is preferable to apply heat and pressure simultaneously. But it is possible to apply heat at first, then to apply heat.

The pressure given to the toner particles constituting the toner image which is transferred to the image supporting material is only required to be 40 to 350 N as a contact loading between the heat roller and the pressure roller in (i) the fixing device of a heat roller method. In (ii) the fixing device of a film roller method, which will be described later, the surface pressure of the fixing belt to the image supporting material is only required to be $9\times10^3$ to $5\times10^5 N/m^2$.

As a fixing device of a heat pressure fixing method in the image forming method using the toner of the present invention, various well-known methods can be used. Below, a fixing device of a heat roller method and a fixing device of a film heating method will be described as examples of a heat pressure fixing device.

(i) Fixing Device of a Heat Roller Method

A fixing device of a heat roller method is provided with, in general, a pair of rollers of a heat roller and a pressure roller which comes in contact with the heat roller. The pressure roller is deformed by the pressure given between the heat roller and the pressure roller to result in forming a fixing nip portion in the deformed portion.

Generally, the heat roller has a composition of a cored bar of a metallic tube roller made of, for example, aluminum, and heat source such as a halogen lamp placed inside of the cored bar. The cored bar is heated by the heat source in such a manner that the turning on electricity to the heat source is controlled and the temperature control is carried out so that the peripheral surface of the heat roller may be maintained to the prescribed fixing temperature.

Especially when the heat roller is used in the fixing device for the full color image forming apparatus which is required to have the ability of sufficiently heat melting to carry out color mixing of the toner image consisting of toner layers of maximum four layers, it is preferable that the heat roller is provided with a cored bar having high heat capacity and having a rubber elastic layer on the peripheral surface of the cored bar in order to carrying out melting of the toner image homogeneously.

Moreover, a pressure roller has an elastic layer which consists of a soft rubber such as a urethane rubber or a silicon rubber.

As a pressure roller, it may be used a roller having a composition of a cored bar of a metallic tube roller made of for example, aluminum, and the peripheral surface of the cored bar being provided with an elastic layer.

In addition, when the pressure roller is composed of a cored bar, it may be placed a heat source such as a halogen lamp like the heat roller inside of the cored bar. The cored bar is heated by the heat source in such a manner that the turning on electricity to the heat source is controlled and the temperature control is carried out so that the peripheral surface of the pressure roller may be maintained to the prescribed fixing temperature.

The outermost surface of the heat roller and/or the pressure roller is preferably provided with a releasing layer made of fluoro resins such as polytetrafluoroethylene (PTFE) and tetrafluoroethylene perfluoroalkyl vinyl ether copolymer (PFA). The thickness of the releasing layer can be set to be about 10 to 30 μm.

In the fixing device of such heat roller method, heating with a heating roller and applying of pressure at a fixing nip portion are done by carrying out hold-conveyance of the image supporting material with rotating a pair of rollers to form a visible image in a fixing nip portion. Thereby, a non-fixed toner image is fixed to the image supporting material.

(ii) Fixing Device of a Film Heat Method

A fixing device of a film heat method is provided with, in general, a heating member composed of a ceramic heater, a pressure roller and a fixing film which is held between the heating member and the pressure roller. The pressure roller is deformed by the pressure given between the heating member and the pressure roller to result in forming a fixing nip portion in the deformed portion.

As a fixing film, there are used a heat resisting film, sheet or belt made of, for example, polyimide. In addition, it may be a composition which uses a heat resisting film, sheet or belt made of polyimide as a film substrate and a releasing layer is provided on the film substrate. The releasing layer is made of fluoro resins such as tetrafluoroethylene (PTFE) or a tetrafluoroethylene perfluoroalkyl ether copolymer (PFA). Furthermore, it may be a composition having an elastic layer made of a rubber provided between the film substrate and the releasing layer.

In the fixing device of such film heat method, the image supporting material carrying a non-fixed toner image thereon is hold-conveyed with the aforesaid fixing belt between the fixing film and the pressure roller which form the fixing nip portion. Heating with a heating member through the fixing film and applying of pressure at a fixing nip portion are done by this process. Thereby, a non-fixed toner image is fixed to the image supporting material.

By using this fixing device of a film heat method, the heating member is made to be in the state of the prescribed temperature by turning on electricity to the heating member only at the time of image formation. It can obtain a quick start property with a short idle time from the input of the power supply to the image formation apparatus until reaching the state where image formation can be performed. The power requirement at the time of standby of the image formation apparatus is also very small, and an advantage of realizing power-saving is acquired.

[Image Supporting Material]

As an image supporting material used for the image formation method using the toner of the present invention, the following materials can be used. Specific examples include: plain papers from thin to thick, coated printing papers such as high quality paper, art paper or coated paper, Japanese paper and postcard paper available on the market, plastic films for OHP, and cloths; however the image supporting material used for the present invention is not limited to them.

As mentioned above, although the embodiments of the present invention were described, the present invention is not limited to the above-mentioned embodiments and various modifications can be made.

EXAMPLES

The present invention will now be described with reference to examples; however, the present invention is not limited to these embodiments.

The measurement of the volume-base median diameter of the polyester resin particles below was performed using the same method used for the measurement of the volume-base median diameter of the above-mentioned toner particles. Furthermore, the measurement of an amine value, an acid value and a hydroxyl group value were performed with the following methods.

[Measuring Method of an Amine Value]

A solution of 1 g of sample dissolved in 50 ml of dimethylformamide was titrated with a potassium hydroxide/methanol solution having a density of 0.01 N. The amine value was determined by the following Numerical Scheme (1).

Amine value=0.561×(amount of dropped titrant [mg])×(potency of dropped titrant)/(weight of sample [g]) Numerical Scheme (1)

[Measuring Method of an Acid Value]

A solution of 1 g of sample dissolved in 100 ml of a mixed solvent of toluene/acetone/methanol (mixing ratio of 75:12.5:12.5) was titrated with a potassium hydroxide/methanol solution having a density of 0.01 N. The amine value was determined by the following Numerical Scheme (2).

Amine value=5.61×(amount of dropped titrant [mg])×(potency of dropped titrant)/(weight of sample [g]) Numerical Scheme (2)

[Measuring Method of a Hydroxyl Group Value]

0.5 g of sample was precisely measured and placed in a 100 ml volumetric flask. After adding 5 ml of acetylation agent to the volumetric flask, the volumetric flask was heated for 2 hours by immersing in a bath having a temperature of 100° C. Then, after the volumetric flask was taken out from the bath and was left cooled, water was added to the volumetric flask and it was shaken. Again, the volumetric flask was heated for 10 minutes by immersing in the bath, then, it was left cooled. The cylindrical wall of the volumetric flask was washed with an organic solvent and acetic anhydride produced as a reaction product was decomposed. The obtained reaction solution was subjected to a potentiometric titration using a potassium hydroxide ethyl alcohol solution having a density of 0.5 N to obtain a hydroxyl group value based on the method of HS K 0070-1966.

[Preparation of Polyester Resin Particle Dispersion Liquid (1)]

(1) First Synthetic Step

In a 5 L flask equipped with a stirrer, a nitrogen gas inlet, a thermo sensor and a distillator were placed a mixture of polycarboxylic acids composed of 12.4 weight parts of terephthalic acid, 12.9 weight parts of fumaric acid, 8.4 weight parts of trimerit acid and a mixture of polyols composed of 76 weight parts of 2,2-bis(4-hydroxyphenyl) propane, 2 mol ethylene oxide adduct and 24 weight parts of 2,2-bis(4-hydroxyphenyl)propane 2 mol propylene oxide adduct. The mixture was stirred with increasing the inner temperature to become 190° C. over 1 hour under a nitrogen gas atmosphere. After confirming that the mixture was uniformly stirred, $Ti(OBu)_4$ was added as a catalyst to the mixture in an amount of 0.003 weight % with respect to the loaded amount of the polycarboxylic acids. Then, the dehydro condensation reaction was continued for 6 hours.

When the acid value of the produced polyester resin (the raw material polyester prepolymer) attained at 20.0 (mg KOH/g) and the hydroxyl value thereof attained at 28.6 (mg KOH/g) in this reaction system, 14.8 weight parts of compound represented by Formula (2-1) was added to react for 2 hours to obtain a polyester resin (hereafter, it is called as "Triphenyl imidazole group containing prepolymer (1)".

The obtained triphenyl imidazole group containing prepolymer (1) had a number average molecular weight of 3,000 measured by GPC. In addition, there was observed no insoluble material in tetrahydrofuran.

(2) Second Synthetic Step

The total amount of the obtained triphenyl imidazole containing group prepolymer (1) was melted to become a melted state. It was transferred in the melted state in an emulsion dispersing apparatus "Cabitron CD 1010" (made by Eurotech, Co., Ltd.) with a transfer speed of 100 weight parts per minute. At the same time of the transfer of the melted triphenyl imidazole group containing prepolymer (1), an aqueous solution composed of 400 weight parts and 10 weight parts of 20% sodium dodecyl sulfate was added in the emulsion dispersing apparatus "Cabitron CD 1010" (made by Eurotech, Co., Ltd.) from the tank for the aqueous solution using a quantitative pump. The aqueous solution was heated to 160° C. with a heat exchange apparatus and it was transferred in the emulsion dispersing apparatus with a transfer speed of 0.1 liter per minute. The emulsion dispersing apparatus "Cabitron CD 1010" (made by Eurotech, Co., Ltd.) was operated under the conditions of a rotating speed of 60 Hz and with a pressure of 5 kg/cm$^2$ for 2 hours to prepare a suspension liquid. The prepared suspension liquid was cooled to 10° C. with a cooling speed of −5° C./min. Then, 5 weight parts of an aqueous solution of potassium ferricyanide having a density of 1 weight % was added as an oxidation agent to react at a temperature of 10° C. for 6 hours. Thus, it was prepared a dispersion liquid in which were dispersed particles made of a polyester resin having a structure represented by Formula (1) wherein $R^1$ and $R^2$ each are a hydrogen atom and L is represented by Formula (a) (hereafter, this dispersion liquid is also called as "Polyester resin particle dispersion liquid (1)").

The volume-based median diameter of the polyester resin particles constituting the prepared polyester resin particle dispersion (1) was 260 nm.

Further, since the polyester resin concerning the prepared polyester resin particle dispersion (1) had a cross-linking structure, it was substantially insoluble in tetrahydrofuran.

[Preparation of Polyester Resin Particle Dispersion (2)]

(1) First Synthetic Step

In a 5 L flask equipped with a stirrer, a nitrogen gas inlet, a thereto sensor and a distillator were placed a mixture of polycarboxylic acids composed of 28.3 weight parts of terephthalic acid and 2.2 weight parts of trimerit acid and a mixture of polyols composed of 8.1 weight parts of 2,2-bis (4-hydroxyphenyl) propane 2 mol propylene oxide adduct and 68.2 weight parts of 2,2-bis(4-hydroxyphenyl)propane 2 mol ethylene oxide adduct. The mixture was stirred with increasing the inner temperature to become 230° C. over 1 hour under a nitrogen gas atmosphere. After confirming that the mixture was uniformly stirred, 2 weight parts of butyltin oxide were added, and the reaction was continued for 6 hours. Subsequently, the reaction was continued for 5 hours under the reduced pressure of 10 mm Hg to produce a polyester resin (a raw material polyester prepolymer). The produced polyester resin had an acid value of 0.5 (mg KOH/g) and a hydroxyl value of 51 (mg KOH/g).

Then, in a reaction vessel equipped with a cooling tube, a stirrer and a nitrogen gas inlet were placed 41 weight parts of the produced polyester resin (the raw material polyester prepolymer), 8.9 weight parts of isophorone diisocyanate and 50 weight parts of ethyl acetate. By reacting the mixture at a temperature of 100° C. for 5 hours, an isocyanate modified polyester resin was obtained. Further, in this system was added 33.0 weight parts of a compound represented by Formula (2-1) to react for 2 hours to obtain a polyester resin (hereafter, it is also called as "triphenyl imidazole group containing prepolymer (2)").

The obtained triphenyl imidazole group containing prepolymer (2) had a number average molecular weight of 3,400 measured by GPC. In addition, there was observed no insoluble material in tetrahydrofuran.

(2) Second Synthetic Step

It was prepared a polyester resin particle dispersion liquid (hereafter, it is also called as "Polyester resin particle dispersion liquid (2)") in the same manner as Preparation Example 1 of a polyester resin particle dispersion liquid, except that the triphenyl imidazole group containing prepolymer (2) was used instead of the triphenyl imidazole group containing prepolymer (1) in the second synthetic step of Preparation Example 1 of a polyester resin particle dispersion liquid. The Polyester resin particle dispersion liquid (2) contains dispersed particles made of a polyester resin having a structure represented by Formula (1) wherein $R^1$ and $R^2$ each are a hydrogen atom and L is represented by Formula (c).

The volume-based median diameter of the polyester resin particles constituting the prepared polyester resin particle dispersion (2) was 320 nm.

Further, since the polyester resin concerning the prepared polyester resin particle dispersion (2) had a cross-linking structure, it was substantially insoluble in tetrahydrofuran.

[Preparation of Polyester Resin Particle Dispersion Liquid (3)]

It was prepared a polyester resin particle dispersion liquid (hereafter, it is also called as "Polyester resin particle dispersion liquid (3)") in the same manner as Preparation Example 1 of a polyester resin particle dispersion liquid, except that 15.0 weight parts of a compound represented by Formula (2-2) was used instead of 14.8 weight parts of a compound represented by Formula (2-1) in Preparation Example 1 of a polyester resin particle dispersion liquid. The Polyester resin particle dispersion liquid (3) contains dispersed particles made of a polyester resin having a structure represented by Formula (1) wherein $R^1$ and $R^2$ each are a hydrogen atom and L is represented by Formula (b).

The volume-based median diameter of the polyester resin particles constituting the prepared polyester resin particle dispersion (3) was 251 nm.

Further, since the polyester resin concerning the prepared polyester resin particle dispersion (3) had a cross-linking structure, it was substantially insoluble in tetrahydrofuran.

[Preparation of Polyester Resin Particle Dispersion Liquid (4)]

It was prepared a polyester resin particle dispersion liquid (hereafter, it is also called as "Polyester resin particle dispersion liquid (4)") in the same manner as Preparation Example 2 of a polyester resin particle dispersion liquid, except that 30.6 weight parts of a compound represented by Formula (2-2) was used instead of 33.0 weight parts of a compound represented by Formula (2-1) in Preparation Example 2 of a polyester resin particle dispersion liquid. The Polyester resin particle dispersion liquid (4) contains dispersed particles made of a polyester resin having a structure represented by Formula (1) wherein $R^1$ and $R^2$ each are a hydrogen atom and L is represented by Formula (d).

The volume-based median diameter of the polyester resin particles constituting the prepared polyester resin particle dispersion (4) was 221 nm.

Further, since the polyester resin concerning the prepared polyester resin particle dispersion (4) had a cross-linking structure, it was substantially insoluble in tetrahydrofuran.

[Preparation of Polyester Resin Particle Dispersion Liquid (5)]

It was prepared a polyester resin particle dispersion liquid (hereafter, it is also called as "Polyester resin particle dispersion liquid (5)") in the same manner as Preparation Example 1 of a polyester resin particle dispersion liquid, except that 23.1 weight parts of a compound represented by Formula (2-3) was used instead of 14.8 weight parts of a compound represented by Formula (2-1) in Preparation Example 1 of a polyester resin particle dispersion liquid. The Polyester resin particle dispersion liquid (5) contains dispersed particles made of a polyester resin having a structure represented by Formula (1) wherein $R^1$ and $R^2$ each are a hydrogen atom and L is represented by Formula (d).

The volume-based median diameter of the polyester resin particles constituting the prepared polyester resin particle dispersion (5) was 273 nm.

Further, since the polyester resin concerning the prepared polyester resin particle dispersion (5) had a cross-linking structure, it was substantially insoluble in tetrahydrofuran.

[Preparation of Polyester Resin Particle Dispersion Liquid (6)]

(1) First Synthetic Step

In a 5 L flask equipped with a stirrer, a nitrogen gas inlet, a thermo sensor and a distillator were placed a mixture of polycarboxylic acids composed of 282 weight parts of terephthalic acid, 1.0 weight part of adipic acid and 4.8 weight parts of trimerit acid and a mixture of polyols composed of 53.3 weight parts of 2,2-bis(4-hydroxyphenyl) propane 2 mol propylene oxide adduct and 13.0 weight parts of 2,2-bis(4-hydroxyphenyl)propane 2 mol ethylene oxide adduct so as to become a total amount of 3 weight parts. The mixture was stirred with increasing the inner temperature to become 210° C. over 1 hour. After confirming that the mixture was uniformly stirred, 3 weight parts of butyltin oxide were added, and the reaction was continued for 8 hours. Subsequently, the reaction was continued for 5 hours under the reduced pressure of 10 mm Hg and 60 weight parts of N-dimethyl-2-aminoethanol was added to react under a normal atmosphere at 120° C. for 24 hours to produce an amino modified polyester resin (a raw material polyester prepolymer).

The produced polyester resin had an acid value of 0.6 (mg KOH/g) and an amine value of 35.4 (mg KOH/g).

Next, 21.0 weight parts of compound represented by Formula (2-3) was added in this system and reacted for 2 hours to obtain a polyester resin (hereafter, it is also called as "triphenyl imidazole group containing prepolymer (6)").

The obtained triphenyl imidazole group containing prepolymer (6) had a number average molecular weight of 2,800 measured by GPC. In addition, there was observed no insoluble material in tetrahydrofuran.

(2) Second Synthetic Step

It was prepared a polyester resin particle dispersion liquid (hereafter, it is also called as "Polyester resin particle dispersion liquid (6)") in the same manner as Preparation Example 1 of a polyester resin particle dispersion liquid, except that the triphenyl imidazole group containing prepolymer (6) was used instead of the triphenyl imidazole group containing prepolymer (1) in the second synthetic step of Preparation Example 1 of a polyester resin particle dispersion liquid. The Polyester resin particle dispersion liquid (6) contains dispersed particles made of a polyester resin having a structure represented by Formula (1) wherein $R^1$ and $R^2$ each are a hydrogen atom and L is represented by Formula (c).

The volume-based median diameter of the polyester resin particles constituting the prepared polyester resin particle dispersion (6) was 204 nm.

Further, since the polyester resin concerning the prepared polyester resin particle dispersion (6) had a cross-linking structure, it was substantially insoluble in tetrahydrofuran.

[Preparation of Polyester Resin Particle Dispersion Liquid (7)]

It was prepared a polyester resin particle dispersion liquid (hereafter, it is also called as "Polyester resin particle dispersion liquid (7)") in the same manner as Preparation Example 1 of a polyester resin particle dispersion liquid, except that 21.4 weight parts of a compound represented by Formula (2-4) was used instead of 14.8 weight parts of a compound represented by Formula (2-1) in Preparation Example 1 of a polyester resin particle dispersion liquid. The Polyester resin particle dispersion liquid (7) contains dispersed particles made of a polyester resin having a structure represented by Formula (1) wherein $R^1$ and $R^2$ each are a hydrogen atom and L is represented by Formula (b).

The volume-based median diameter of the polyester resin particles constituting the prepared polyester resin particle dispersion (7) was 274 nm.

Further, since the polyester resin concerning the prepared polyester resin particle dispersion (7) had a cross-linking structure, it was substantially insoluble in tetrahydrofuran.

[Preparation of Polyester Resin Particle Dispersion Liquid (8)]

It was prepared a polyester resin particle dispersion liquid (hereafter, it is also called as "Polyester resin particle dispersion liquid (8)") in the same manner as Preparation Example 6 of a polyester resin particle dispersion liquid, except that 23.1 weight parts of a compound represented by Formula (2-4) was used instead of 21.0 weight parts of a compound represented by Formula (2-3) in Preparation Example 6 of a polyester resin particle dispersion liquid. The Polyester resin particle dispersion liquid (8) contains dispersed particles made of a polyester resin having a structure represented by Formula (1) wherein $R^1$ and $R^2$ each are a hydrogen atom and L is represented by Formula (a).

The volume-based median diameter of the polyester resin particles constituting the prepared polyester resin particle dispersion (8) was 274 nm.

Further, since the polyester resin concerning the prepared polyester resin particle dispersion (8) had a cross-linking structure, it was substantially insoluble in tetrahydrofuran.

[Preparation of Triphenyl Imidazole Group Containing Prepolymer Particle Dispersing Liquid (1)]

It was prepared a triphenyl imidazole group containing prepolymer (1) particle dispersion liquid (hereafter, it is also called as "Triphenyl imidazole group containing prepolymer particle dispersing liquid (1)") in the same manner as Preparation Example 1 of a polyester resin particle dispersion liquid, except that the reaction using 5 weight parts of an aqueous solution of potassium ferricyanide having a density of 1 weight % at a temperature of 10° C. for 6 hours was not done in the second synthetic step of Preparation Example 1 of a polyester resin particle dispersion liquid. The obtained triphenyl imidazole group containing prepolymer particle dispersing liquid (1) is similar to the suspension liquid prepared in the second synthetic step of Preparation Example 1 of a polyester resin particle dispersion liquid.

The volume-based median diameter of the polyester resin particles constituting the prepared triphenyl imidazole group containing prepolymer particle dispersing liquid (1) was 210 nm.

[Preparation of Releasing Agent Particle Dispersion Liquid (1)]

There were mixed 60 weight parts of citric acid tribehanate wax (melting point: 83.2° C.) as a releasing agent, 5 weight parts of "Neogen RK" (made by Dai-Ichi Kogyo Seiyaku Co., Ltd.) as an ionic surfactant and 240 weight parts of ion-exchanged water. The mixed solution was heated at 95° C. and it was fully dispersed using a homogenizer "ULTRATAX T50" (made by IKA Co., Ltd). Then, by performing a dispersion treatment with a pressure discharge type Gaulin homogenizer, it was prepared a releasing agent particle dispersion liquid (hereafter, it is called as "Releasing agent particle dispersion liquid (1)") having a volume average diameter of 240 nm and an amount of solid content of 20 weight parts.

[Preparation of Colorant Particle Dispersion Liquid (1)]

11.5 weight parts of n-sodium dodecyl sulfate was dissolved in 160 weight parts of ion exchange water with stirring. While stirring the obtained solution, 25 weight parts of C. I. Aigment Blue 15:3 were gradually added to the solution as a colorant. Then, by performing a dispersion treatment with a mixing means of "CLEAR MIX W-MOTION CLM-0.8" (made by M Technique Co.), it was prepared an aqueous dispersion liquid of colorant particles (hereafter, it is called as "Colorant particle dispersion liquid (1)") having a volume-based median diameter of 158 nm.

In addition, the volume-based median diameter of colorant particles was measured using "MICROTRAC UAA 150" (made by HONEYWELL Co., Ltd.). The measuring conditions were as follows, sample refractivity index: 1.59; sample specific gravity: 1.05 (spherical particle conversion); solvent refractivity index: 1.33; solvent viscosity: 0.797 (at 30° C.) and 1.002 (at 20 ° C.); and zero point adjustment was done by placing ion-exchanged water into a measuring cell.

[Preparation of Toner (1)]

In a zebra flask equipped with a stirrer, a thermo sensor, a cooling tube and a nitrogen gas inlet were placed 400 weight parts (solid portion conversion) of Polyester resin particle dispersion liquid (1), 1,500 weight parts of ion-exchanged water, 165 weight parts of Colorant particle dispersion liquid (1) and 200 weight parts of Releasing agent particle dispersion liquid (1). After adjusting the liquid temperature to be 30° C., an aqueous sodium potassium solution having a concentration of 25 weight% was added to adjust the pH value of the solution to be 10.

Next, an aqueous solution containing 54.3 weight parts of magnesium chloride 6 hydrate dissolved in 54.3 weight parts of ion-exchanged water was added to the solution, and the temperature of the solution was raised to 60° C. so as to start the aggregation reaction of the polyester resin particles (binder resin particles) and the colorant particles.

After starting of this aggregation reaction, sampling was done periodically. The volume-based median diameter of the aggregated particles was measured using a particle size distribution analyzer "Coulter Multisizer 3" (made by Beckmann Coulter Co., Ltd.). Stirring was continued until the volume-based median diameter (D50) became to 6.0 μm. Stirring was continued further 1 hour with keeping the inner temperature at 60° C. Then, 20.1 weight parts of ethylenediamine tetracarboxylic acid were added. The circularity of the produced aggregated particles was measured using a flow type particle image analyzer "FAIA-2100" (made by Sysmex Co., Ltd.). The circularity was found to be 0.951.

Then, the temperature of the system was raised to 85° C., and stirring was continued for 4 hours. When the circularity became 0.976 measured with a flow type particle image analyzer "FAIA-2100" (made by Sysmex Co., Ltd.), the system was cooled to 30° C. under the decreasing condition of 6° C. per minute to obtain a dispersion liquid of colorant particles.

The dispersion liquid of colorant particles thus obtained was subjected to a solid-liquid separation using a basket type centrifuge "MARK III, model number 60×40" (made by Matsumoto Machine Co., Ltd.) to obtain a wet cake. Cleaning and solid-liquid separation were repeated until the electrical conductivity of filtrate became 15 μS/cm with the above-mentioned basket type centrifuge for this wet cake. Then, the dry process of was carried out to this wet cake until the moisture content became 0.5 weight % using the "Flash Jet Dryer" (made by Seishin Enterprise Co., Ltd.) $b_y$ spraying the air current of the temperature of 40° C. and the humidity of 20% RH. Thus, toner particles (they are also called as "Toner particles (1)" having a volume-based median diameter of 6 μm were obtained.

To the obtained toner particles (1) was added 1.0 weight part of hydrophobic silica particles, and they were mixed using a Henschel mixer for 20 minutes under the condition of a circumferential speed 24 m/s of a rotary wing. Then, by passing the screen of 400 meshes, the external additive was added the toner particles (1) and a toner was obtained (hereafter, it is called as "Toner (1)").

The obtained toner (1) is a toner of the present invention, which was produced by the production method concerning the present invention. The structure of the compound of the present invention represented by Formula (1) was confirmed by $H^1$ NMR and $C^{13}$ NMR.

In addition, in Toner (1), the form and the particle size of the used toner particles were not changed by the addition of the hydrophobic silica particles.

[Preparation of Toners (2) to (8)]

Toners (2) to (8) each were prepared in the same manner as preparation of Toner (1) except that Polyester resin particle dispersion liquid (1) was replaced with Polyester resin particle dispersion liquids as shown in Table 1.

The obtained Toners (2) to (8) each are a toner of the present invention, which were produced by the production method concerning the present invention. The structures of the compounds of the present invention represented by Formula (1) were confirmed by $H^1$ NMR and $C^{13}$ NMR.

[Preparation of Toner (9)]

Toner (9) was prepared in the same manner as preparation of Toner (1) except that the following change was done: Polyester resin particle dispersion liquid (1) was replaced with Triphenyl imidazole group containing prepolymer (1); at the moment of adding ethylenediamine tetracarboxylic acid, the inner temperature of the system was cooled to 10 C.°, and then, 5 weight parts of an aqueous solution of potassium ferricyanide having a density of 1 weight % was added as an oxidation agent to react at a temperature of 10° C. for 6 hours. By this reaction, it was prepared a toner containing a polyester resin having a structure represented by Formula (1) wherein $R^1$ and $R^2$ each are a hydrogen atom and L is represented by Formula (a) (hereafter, this toner is called as Toner (9)).

Since the polyester resin constituting the Toner (9) had a cross-linking structure, it was substantially insoluble in tetrahydrofuran.

The obtained toner (9) is a toner of the present invention, which was produced by the production method concerning the present invention.

[Preparation of Toners (10) to (12)]

Toners (10) to (12) each were prepared in the same manner as preparation of Toner (1) except that Polyester resin particle dispersion liquid (1) was replaced with Polyester resin particle dispersion liquids as shown in Table 1.

The obtained Toners (10) to (12) each are a toner of the present invention, which were produced by the production method concerning the present invention.

Since the polyester resins constituting the Toners (10) to (12) had a cross-linking structure, they were substantially insoluble in tetrahydrofuran.

The triphenyl imidazole compound used for the polyester resin particle dispersion liquid contained in Toner (10) is represented by the following Formula (2-5), which has a structure represented by Formula (2) in which $R^1$ is a chlorine atom bonded to a metha position with respect to the imidazole Ting; and $R^3$ is an amino group.

The triphenyl imidazole compound used for the polyester resin particle dispersion liquid contained in Toner (11) is represented by the following Formula (2-6), which has a structure represented by Formula (2) in which $R^2$ is a chlorine atom bonded to a metha position with respect to the imidazole ring, and there are two phenyl groups; and $R^3$ is an amino group.

The triphenyl imidazole compound used for the polyester resin particle dispersion liquid contained in Toner (12) is represented by the following Formula (2-7), which has a structure represented by Formula (2) in which $R^2$ is a methoxy group bonded to a metha position with respect to the imidazole ring, and there are two phenyl groups; and $R^3$ is an amino group.

Formula (2-5)

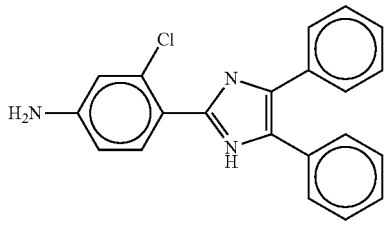

Formula (2-6)

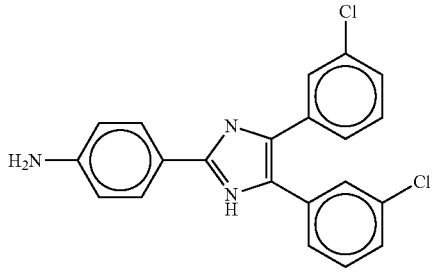

Formula (2-7)

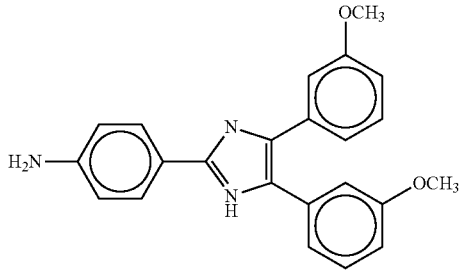

<Preparation of Developer>

Developers (I) to (12) each were prepared by respectively mixing Toner (1) to (12) and the ferrite carrier covered with the silicone resin and having a volume-based median diameter of 60 μm using a V shaped mixer so that the concentration of the toner became 6 weight %.

The following evaluations were performed about Toners (1) to (12) which constitute Developers (1) to (12) which were obtained. The evaluation results are shown in Table 1.

(1) Evaluation of Low-Temperature Fixability

A commercially available multifunctional peripheral "bizhub PRO C6501" (produced by Konica Minolta Business Technologies, Inc.) was used as an image forming apparatus. In this apparatus was loaded each of Developers (1) to (12) as a developer. The surface temperature of the heat fixing component in the fixing means of the image forming apparatus using heat roller fixing was allowed to vary at regular intervals of 5° C. in the range of 80 to 150° C.; at each temperature, image formation was performed using a paper having a weighting of 350 g as an image supporting material under the atmosphere of normal temperature and normal humidity (temperature: 20° C.; humidity: 50% RH). A visible solid image print having an image density of 0.8 was obtained. The obtained solid image print was subjected to measure a bent fixation rate. When the value of this bent fixation rate exceeded 80%, the surface temperature of the heat fixing component was considered to be the fixable temperature. It was decided that low-temperature fixability was achieved to the case where this fixable temperature was 140° C. or less. That is, in this evaluation, the case where low-temperature fixing temperature is 140° C. or less is an acceptance level.

Here, a bent fixation rate indicates the generation ratio of the toner separation in the bent part using a fixation rate, when a print having the fixed toner is bent.

Specific process is as follows. A solid image print having an image density of 0.8 is bent, then, the image is rubbed three times with a finger. After the image print is unbent, the image is wiped three times with a sheet of JK wiper (Cresia Co., Ltd.). A bent fixation rate is obtained from the image densities at the bent part of before being bent and after being bent using the following Numerical Scheme (3).

$$\text{Bent fixation rate}=\{(\text{Image density after being bent})/(\text{Image density before being bent})\}\times 100 \quad \text{Numerical Scheme (3)}$$

(2) Evaluation of Filming-Resistant Property

A commercially available multifunctional peripheral "bizhub PRO C6501" (produced by Konica Minolta Business Technologies, Inc.) was used as an image forming apparatus. In this apparatus was loaded each of Developers (1) to (12) as a developer. Continuous printing test was carried out under the conditions of temperature of 33° C. and humidity of 80% RH. The existence of generation of toner filming is checked during the printing test by carrying out visual observation to the photoreceptor and the intermediate transfer member. With it, the accumulated number of print sheets which began the image defect (white line) resulting from the toner filming on the output prints was checked, and the filming-resistant property was evaluated by the following evaluation criteria. In this evaluation, Rank A and Rank B were made into an acceptable level, and Rank C was made into unacceptable level.

Rank A: The generation of the toner filming is not seen at all until it becomes 1,200,000 of the accumulated number of print sheets; and an image defect is not seen at all on the output prints.

Rank B: The generation of an image defect is not seen on the output prints until it becomes 800,000 of the accumulated number of print sheets; and although a slight toner filming is observed on the photoreceptor or on the intermediate transfer member until it becomes 1,200,000 of the accumulated number of print sheets, an image defect is not detected on the output prints.

Rank C: The generation of an image defect is detected on the output prints until it becomes 800,000 of the accumulated number of print sheets.

(3) Evaluation of Granularity

A commercially available multifunctional peripheral "bizhub PRO C6501" (produced by Konica Minolta Business Technologies, Inc.) was used as an image forming apparatus. In this apparatus was loaded each of Developers (1) to (12) as a developer. Image formation was performed to obtain a half tone image print consisting of three patch picture images having the light cyan colors in 10 step cyan colors. The granularity of the acquired half tone image print was evaluated by the following criteria using "Test chart No. 7 made by The Imaging Society of Japan". As a half tone image print, the three patch images made of the light cyan colors in 10 step cyan colors were relatively compared.

(Evaluation Criteria)

Rank A: Granularity is not detected with naked eyes, and when the area between dots is observed with a loupe of 20 times magnification, there are observed no particles leading to a dust.

Rank B: Slight granularity is detected when the print is closely observed with naked eyes, or when the area between dots is observed with a loupe of 20 times magnification, there are observed 1 to 3 particles leading to a dust.

Rank C: Granularity is felt compared with the image print of "Rank B", or when the area between dots is observed with a loupe of 20 times magnification, there are observed an uncountable number of particles leading to a dust.

[Evaluation of Sticking of Two Side Image Prints]

A commercially available digital process copying machine "C6550" (made by Konica Minolta Business Technologies, Inc) was equipped with an exclusive finisher "FS-608" (made by Konica Minolta Business Technologies, Inc.). In this apparatus was loaded each of Developers (1) to (12) as a developer. The pixel rate per page was set up to 50%, and a two side glossy paper "POD Gloss Coat A4" (Oji paper Co., Ltd; 100 g/cm$^2$) was used as an image supporting material. It was performed an automatic bookbinding production test of 20 copies (5 per copy) of inside binding printing was repeated 50 times. After carrying out self-cooling until the obtained printing matters became to room temperature, all the pages were turned over with a single hand, and the existence of adhesion between picture images was checked. Sticking of two side image prints was evaluated according to the following criteria.

A (Excellent): Adhesion between the picture images in the piled-up pages is not recognized, and there is no sense discomfort when turning over pages.

B (Good): Although there is a slight feeling of friction when turning over the piled-up pages, adhesion between picture images is not recognized.

C (Acceptable for practice): Although adhesion between picture images is recognized when turning over the piled-up pages, an image defect for not generating and practical use is possible.

D (Non-acceptable): Adhesion between picture images is recognized when turning over the piled-up pages, and an image defect caused by the transfer of the picture image at a contact surface is taken place, or the coating agent of the image supporting material forms an image defect of a white spot, as a result, the total image quality is poor.

| | | Polyester resin | | | | Evaluation | | | |
|---|---|---|---|---|---|---|---|---|---|
| | Developer Number | Polyester resin particle dispersion liquid number | L in Formula (1) | Modified condition of Raw material polyester prepolymer | Triphenyl imidazole compound | Low-temperature fixability (° C.) | Filming-resistant property | Image granularity | Sticking of two side image prints |
| Toner (1) | (1) | (1) | Formula (a) | Non-modified | Formula (2-1) | 125 | A | A | A |
| Toner (2) | (2) | (2) | Formula (c) | Isocyanate modified | Formula (2-1) | 130 | A | A | A |
| Toner (3) | (3) | (3) | Formula (b) | Non-modified | Formula (2-2) | 120 | A | A | A |
| Toner (4) | (4) | (4) | Formula (d) | Isocyanate modified | Formula (2-2) | 120 | A | A | A |
| Toner (5) | (5) | (5) | Formula (d) | Non-modified | Formula (2-3) | 115 | B | A | A |
| Toner (6) | (6) | (6) | Formula (c) | Amino modified | Formula (2-3) | 135 | B | A | B |
| Toner (7) | (7) | (7) | Formula (b) | Non-modified | Formula (2-4) | 125 | B | A | B |
| Toner (8) | (8) | (8) | Formula (a) | Amino modified | Formula (2-4) | 125 | B | A | B |
| Toner (9) | (9) | — | Formula (a) | Non-modified | Formula (2-1) | 115 | B | A | B |
| Toner (10) | (10) | (10) | Formula (a) | Non-modified | Formula (2-5) | 130 | B | B | A |
| Toner (11) | (11) | (11) | Formula (a) | Non-modified | Formula (2-6) | 130 | B | B | A |
| Toner (12) | (12) | (12) | Formula (a) | Non-modified | Formula (2-7) | 130 | B | B | A |

What is claimed is:

1. A toner comprising toner particles containing a polyester resin which has a structure part represented by Formula (1):

Formula (1)

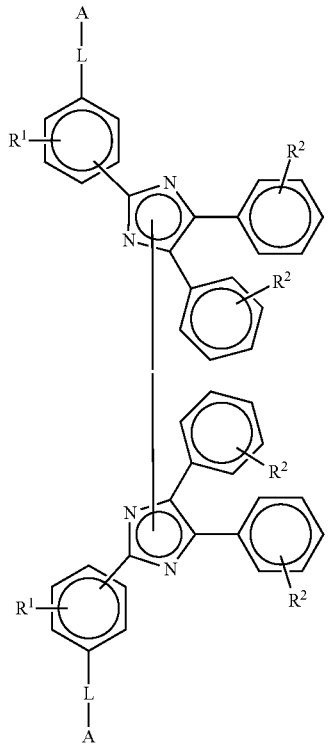

wherein, "A" represents a polyester structure unit having at least one linking group; $R^1$ represents a hydrogen atom, or a chlorine atom; $R^2$ represents a hydrogen atom, a chlorine atom, or a methoxy group; and "L" represents a divalent organic group.

2. The toner of claim 1, wherein "L" in Formula (1) is a group represented by any one of Formulas (a) to (d):

Formula (a)

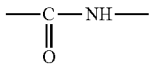

Formula (b)

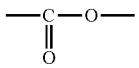

Formula (c)

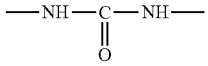

Formula (d)

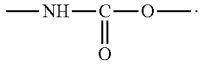

3. The toner of claim 1, wherein $R^1$ and $R^2$ in Formula (1) each are a hydrogen atom.

4. The toner of claim 1, wherein the polyester structure unit represented by "A" in Formula (1) contains a structure part derived from an unsaturated polycarboxylic acid.

5. A method for producing the toner of claim 1, comprising the steps of:

(i) preparing a polyester prepolymer which has a triphenyl imidazole group introduced by a triphenyl imidazole compound represented by Formula (2); and (ii) reacting the polyester prepolymer which has the triphenyl imidazole group under existence of an oxidizing agent to obtain the polyester resin which has the structure part represented by Formula (1):

Formula (2)

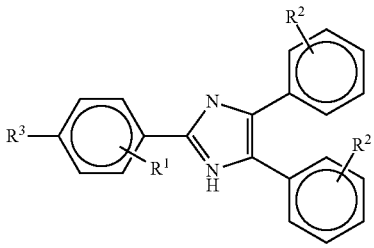

wherein $R^1$ represents a hydrogen atom, or a chlorine atom; $R^2$ represents a hydrogen atom, a chlorine atom, or a methoxy group; and $R^3$ represents an amino group, a hydroxyl group, a carboxyl group, or an isocyanate group.

6. The method for producing the toner of claim 5, wherein:

(a) one of the triphenyl imidazole compound represented by Formula (2) and the polyester prepolymer, both of which are used for preparing the polyester prepolymer having the triphenyl imidazole group in the molecule, has a group containing an active hydrogen atom; and (b) the other which has not the active hydrogen atom has an isocyanate group or a carboxyl group; and the triphenyl imidazole group is introduced in the polyester prepolymer by combining these two groups of (a) and (b) through reaction.

7. The method for producing the toner of claim 5, wherein the polyester prepolymer having a triphenyl imidazole group is produced by reacting a non-modified polyester prepolymer and a triphenyl imidazole compound represented by Formula (2-1) to obtain the polyester resin in which "L" in Formula (1) is represented by Formula (a):

Formula (2-1)

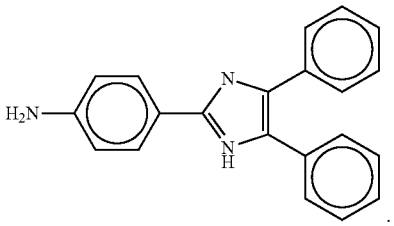

8. The method for producing the toner of claim 5, wherein the polyester prepolymer having a triphenyl imidazole group is produced by reacting an isocyanate modified polyester prepolymer and a triphenyl imidazole compound represented by Formula (2-1) to obtain the polyester resin in which "L" in Formula (1) is represented by Formula (c).

9. The method for producing the toner of claim 5, wherein the polyester prepolymer having a triphenyl imidazole group is produced by reacting a non-modified polyester prepolymer and a triphenyl imidazole compound represented by Formula (2-2) to obtain the polyester resin in which "L" in Formula (1) is represented by Formula (b).

10. The method for producing the toner of claim 5, wherein the polyester prepolymer having a triphenyl imidazole group is produced by reacting an isocyanate modified polyester prepolymer and a triphenyl imidazole compound represented by Formula (2-2) to obtain the polyester resin in which "L" in Formula (1) is represented by Formula (d).

11. The method for producing the toner of claim 5, wherein the polyester prepolymer having a triphenyl imidazole group is produced by reacting a non-modified polyester prepolymer and a triphenyl imidazole compound represented by Formula (2-3) to obtain the polyester resin in which "L" in Formula (1) is represented by Formula (d):

Formula (2-3)

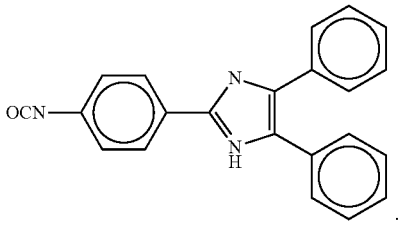

12. The method for producing the toner of claim 5, wherein the polyester prepolymer having a triphenyl imidazole group is produced by reacting an amino modified polyester prepolymer and a triphenyl imidazole compound represented by Formula (2-3) to obtain the polyester resin in which "L" in Formula (1) is represented by Formula (c).

13. The method for producing the toner of claim 5, wherein the polyester prepolymer having a triphenyl imidazole group is produced by reacting a non-modified polyester prepolymer and a triphenyl imidazole compound represented by Formula (2-4) to obtain the polyester resin in which "L" in Formula (1) is represented by Formula (b).

14. The method for producing the toner of claim 5, wherein the polyester prepolymer having a triphenyl imidazole group is produced by reacting an amino modified polyester prepolymer and a triphenyl imidazole compound represented by Formula (2-4) to obtain the polyester resin in which "L" in Formula (1) is represented by Formula (a).

* * * * *